US007882994B2

(12) United States Patent
Francescon

(10) Patent No.: US 7,882,994 B2
(45) Date of Patent: Feb. 8, 2011

(54) 45 DEGREE ADJUSTABLE ADAPTER FOR FLOORING NAILER

(75) Inventor: Ottaviano Francescon, Conegliano (IT)

(73) Assignee: Illinois Tool Works Inc., Glenview, IL (US)

( * ) Notice: Subject to any disclaimer, the term of this patent is extended or adjusted under 35 U.S.C. 154(b) by 177 days.

(21) Appl. No.: 12/096,112

(22) PCT Filed: Jan. 4, 2007

(86) PCT No.: PCT/US2007/060101

§ 371 (c)(1),
(2), (4) Date: Jun. 4, 2008

(87) PCT Pub. No.: WO2007/082136

PCT Pub. Date: Jul. 19, 2007

(65) Prior Publication Data

US 2008/0296341 A1 Dec. 4, 2008

(51) Int. Cl.
*B25C 7/00* (2006.01)

(52) U.S. Cl. ..... 227/148; 227/8; 227/140; 227/147; 227/151; 227/119; 227/156

(58) Field of Classification Search ..... 227/8, 227/140, 147–148, 151, 119, 156
See application file for complete search history.

(56) References Cited

U.S. PATENT DOCUMENTS 2,169,433 A * 8/1939 Roy ..... 227/110
2,822,544 A * 2/1958 Anstett ..... 227/148
2,866,199 A * 12/1958 Freeman et al. ..... 173/121
3,012,247 A * 12/1961 Sillars et al. ..... 227/121
3,281,046 A * 10/1966 Boulay ..... 227/115
6,318,620 B1 * 11/2001 Anstett et al. ..... 227/147

(Continued)

FOREIGN PATENT DOCUMENTS

CN 2855655 Y 1/2007

(Continued)

OTHER PUBLICATIONS

Search Report for Taiwan Invention Patent Application No. 096100572 issued on Apr. 3, 2009.

(Continued)

*Primary Examiner*—Rinaldi I. Rada
*Assistant Examiner*—Michelle Lopez
(74) *Attorney, Agent, or Firm*—Levenfeld Pearlstein, LLC

(57) ABSTRACT

An adjustable adapter configured to position a fastening tool for driving a fastener into tongue-and-groove flooring material in order to secure the flooring material to a subfloor is disclosed. The adapter comprises a fastening tool mounting plate, a base slidably mounted to the bottom of the mounting plate and a support plate slidably mounted to the top of the mounting plate. A nose plate of the fastening tool is secured to the mounting plate between the mounting plate and the support plate and a safety actuator arm is disposed between the mounting plate and the nose plate. The base and the support plate are movable such that the adapter can be configured to engage the tongue and the top surface of various sizes and configurations of tongue-and-groove flooring materials in order to maintain a desired fastener driving angle and insertion location.

14 Claims, 3 Drawing Sheets

U.S. PATENT DOCUMENTS

| | | | | |
|---|---|---|---|---|
| 6,631,836 | B2 | 10/2003 | Dickhaut | |
| 6,824,036 | B2 | 11/2004 | Walter | |
| 6,843,402 | B2 | 1/2005 | Sims | |
| 7,051,914 | B2 * | 5/2006 | Herelier | 227/110 |
| 7,344,057 | B2 * | 3/2008 | Dion et al. | 227/8 |
| 7,419,078 | B2 * | 9/2008 | Hamar | 227/111 |
| 7,721,817 | B2 * | 5/2010 | McGee et al. | 173/37 |
| 2001/0038026 | A1 | 11/2001 | Dickhaut | |
| 2005/0145670 | A1 * | 7/2005 | Huang | 227/148 |
| 2007/0215665 | A1 * | 9/2007 | Ohmori | 227/8 |

FOREIGN PATENT DOCUMENTS

| | | | |
|---|---|---|---|
| EP | 0386878 | A3 | 1/1991 |
| JP | 2002273671 | A | 9/2002 |
| TW | 225175 | | 6/1994 |
| TW | 417574 | | 1/2001 |
| TW | 592909 | | 6/2004 |
| TW | M250773 | | 11/2004 |

OTHER PUBLICATIONS

International Search Report (dated Oct. 11, 2007) for PCT/US07/060101 (filed Jan. 4, 2007).

* cited by examiner

45 DEGREE ADJUSTABLE ADAPTER FOR FLOORING NAILER

BACKGROUND OF THE INVENTION

The present invention pertains to an adapter for a fastening tool. More particularly, the invention pertains to an adjustable adapter configured to position a fastening tool, such as a flooring nailer or stapler, to drive a fastener, such as a nail or staple, at a desirable angle and into a desirable location in tongue-and-groove flooring material.

In the construction industry, tongue-and-groove materials are commonly used to install floors. As is known in the prior art, such tongue-and-groove materials typically comprise wood strips (or shingles) formed with a tongue extending outwardly from one edge of the strip and a groove formed in the opposite edge of the strip. The wood strips are positioned on a subfloor and aligned such that the groove of one strip matingly receives the tongue of an adjacent strip.

However, before the tongue and the groove of adjacent strips are joined, a fastener is driven through the tongue edge of the strip in order to secure the strip to the subfloor. In the prior art, powered fastening tools, such as pneumatic nailers and staplers, have been used to drive fasteners, such as nails and staples, through the strip and into the subfloor.

It has been found that the fastener should preferably be driven through the strip and into the subfloor at a 45 degree angle relative to the subfloor surface. Moreover, it has been found that the fastener should preferably be driven into the strip at a location above the tongue and into the corner where the tongue begins to extend from the edge of the strip.

Because a strip is fastened to the subfloor through the tongue edge of the strip before the groove of an adjacent strip is matingly engaged with the tongue, to achieve a tight, flush fit between adjacent strips, it is important that the fastener be driven into the strip at the preferred location so that the fastener does not interfere with or inhibit the mating engagement of the tongue and groove.

Many powered fastening tools are designed to be portable and mobile, and some may be bulky and heavy. Therefore, without the aid of a positioning device, it may be difficult to properly align the tool, and maintain the tool in the desired alignment, in order to drive the fastener at the preferred angle and at the preferred location. To that end, the prior art has developed a number of mounts and similar devices configured to align and secure the fastening tool in a desired position.

For example, U.S. Pat. No. 6,631,836, issued to Dickhaut, for an "Accessory Device for Nail and Staple Guns," discloses a non-adjustable shoe for positioning a fastening tool relative to a target material and providing sufficient spacing and orientation between a fastening tool and the target material.

While the disclosed Dickhaut device may be useful for aligning a fastening tool with tongue-and-groove flooring material, its usefulness is limited because tongue-and-groove flooring may come in various thicknesses and tongue configurations, and the device is not adjustable to accommodate such variations.

Another prior art device is disclosed in U.S. Pat. No. 6,843,402, issued to Sims et al., for an "Adjustable Tool Mount." Sims et al. discloses an adjustable tool mount for fastening tools used to install tongue-and-groove flooring. The Sims et al. device is a relatively complex combination of slidably mounted plates and carriers configured to permit a fastening tool to be mounted thereto and aligned with the tongue of a tongue-and-grove flooring strip.

While the Sims et al. mount does permit the position of the fastening tool to be adjusted to accommodate various thicknesses and configurations of tongue-and-groove flooring, the mount engages the flooring material only at the underside of the tongue. Because the force generated upon activation of the fastening tool may be high, it would be advantageous for the mount to securely engage the flooring material at multiple interfaces to minimize the likelihood that the mount will move during the fastener driving operation.

Accordingly, there exists a need for an adjustable adapter for tongue-and-groove flooring material that configured to position a fastening tool for properly driving a fastener into the flooring material to secure it to a subfloor. Desirably, such an adapter is operable with many types of prior art fastening tools, such as nail guns and staple guns. More desirably, the adapter is configured to drive the fastener at a 45 degree angle relative to the subfloor and into the corner above the tongue where the tongue begins to extend from the edge of the flooring material. More desirably still, the adapter engages the flooring material at multiple interfaces, including the tongue and top surface of the flooring material, to provide support during the fastener driving operation. Most desirably, the adapter is configured to be adjustable to position the fastening tool properly for driving a fastener in many different sizes and styles of tongue-and-groove flooring materials.

BRIEF SUMMARY OF THE INVENTION

The present invention pertains to an adjustable adapter configured to position a fastening tool for properly driving a fastener into tongue-and-groove flooring material to secure the flooring material to a subfloor. The adapter may be integrated into the body of the fastening tool, manufactured as an attachment or manufactured as a separate tool.

In the preferred embodiment, the adapter comprises a fastening tool mounting plate, a base slidably mounted to the bottom of the mounting plate and a support plate slidably mounted to the top of the mounting plate. The nose plate of a fastening tool is disposed between the mounting plate and the support plate and a safety actuator arm is disposed between the mounting plate and the nose plate. The fastening tool is secured to the adapter using a plurality of attachment screws extending through the mounting plate and the nose plate and into the fastening tool body.

The base is configured to maintain the mounting plate, and thus the fastening tool, at a 45 degree angle relative to the subfloor. The mounting plate is configured to engage the tongue of the tongue-and-groove flooring material in order to direct the fastener into the corner above the tongue where the tongue begins to extend from the edge of the flooring material. The support plate is configured to engage the top surface of the flooring material in order to provide support during the fastener driving operation to prevent the adapter from moving.

The base, mounting plate and support plate are fastened together using a plurality of adjustment screws extending through bores formed in the base, mounting plate and support plate. Adjustment knobs threadably engaged with the adjustment screws may be loosened to permit the base and support plate to slidably move relative to the mounting plate such that the mounting plate and the support plate may be positioned properly engage the tongue and the top surface, respectively, of various sizes and configurations of tongue-and-groove flooring material.

These and other features and advantages of the present invention will be apparent from the following detailed description and drawings in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
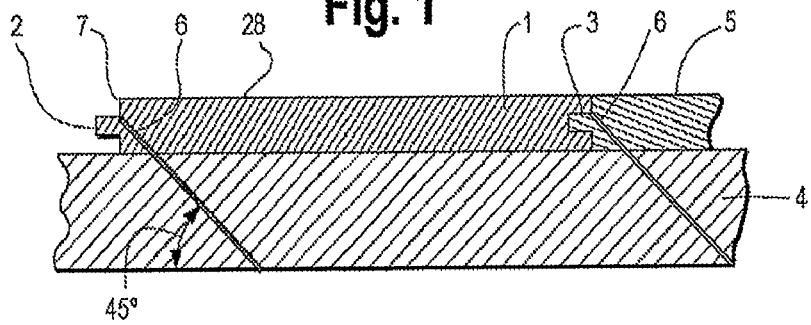
FIG. 1 is a cross-sectional view of a tongue-and-groove flooring strip disposed on a subfloor with a fastener extending through strip into the subfloor.

While the present invention is susceptible of embodiment in various forms, there is shown in the drawings and will hereinafter be described several preferred embodiments with the understanding that the present disclosure is to be considered an exemplification of the invention and is not intended to limit the invention to the specific embodiments illustrated.

It should be further understood that the title of this section of the specification, namely, "Detailed Description of the Invention," relates to a requirement of the United States Patent Office, and does not imply, nor should be inferred to limit the subject matter disclosed herein.

In the construction industry, tongue-and-groove materials are commonly used to install floors. As shown in FIG. 1, such tongue-and-groove flooring materials often comprise wood strips (or shingles) 1. Strip 1 is formed with a tongue 2 extending outwardly from one edge of strip 1 and a groove 3 formed in an opposite edge of strip 1. Strip 1 is positioned on a subfloor 4 and aligned such that groove 3 of strip 1 matingly receives the tongue of an adjacent strip 5.

However, before the tongue and the groove of adjacent strips are joined, a fastener, such as a nail or a staple, is driven through the tongue edge of the strip in order to secure strip to subfloor. As discussed above, powered fastening tools, such as pneumatic or electric nailers and/or staplers, are used to drive the fastener through strip into subfloor.

As shown in FIG. 1, fastener 6 is driven through strip 1 preferably at a 45 degree angle relative to subfloor 4. Moreover, fastener 6 is preferably driven into strip 1 into the corner 7 above tongue 2 where tongue 2 begins to extend from the edge of strip 1.

The present invention pertains to an adjustable adapter configured to position a fastening tool for properly driving a fastener into tongue-and-groove flooring material to secure the flooring material to the subfloor. The adapter aligns the fastening tool at a 45 degree angle relative to the subfloor such that the fastener is driven through the flooring material and into the subfloor at a 45 degree angle. Moreover, the adapter is configured to direct the fastener into the corner above the tongue where the tongue begins to extend from the edge of the flooring material.

Figure 2:
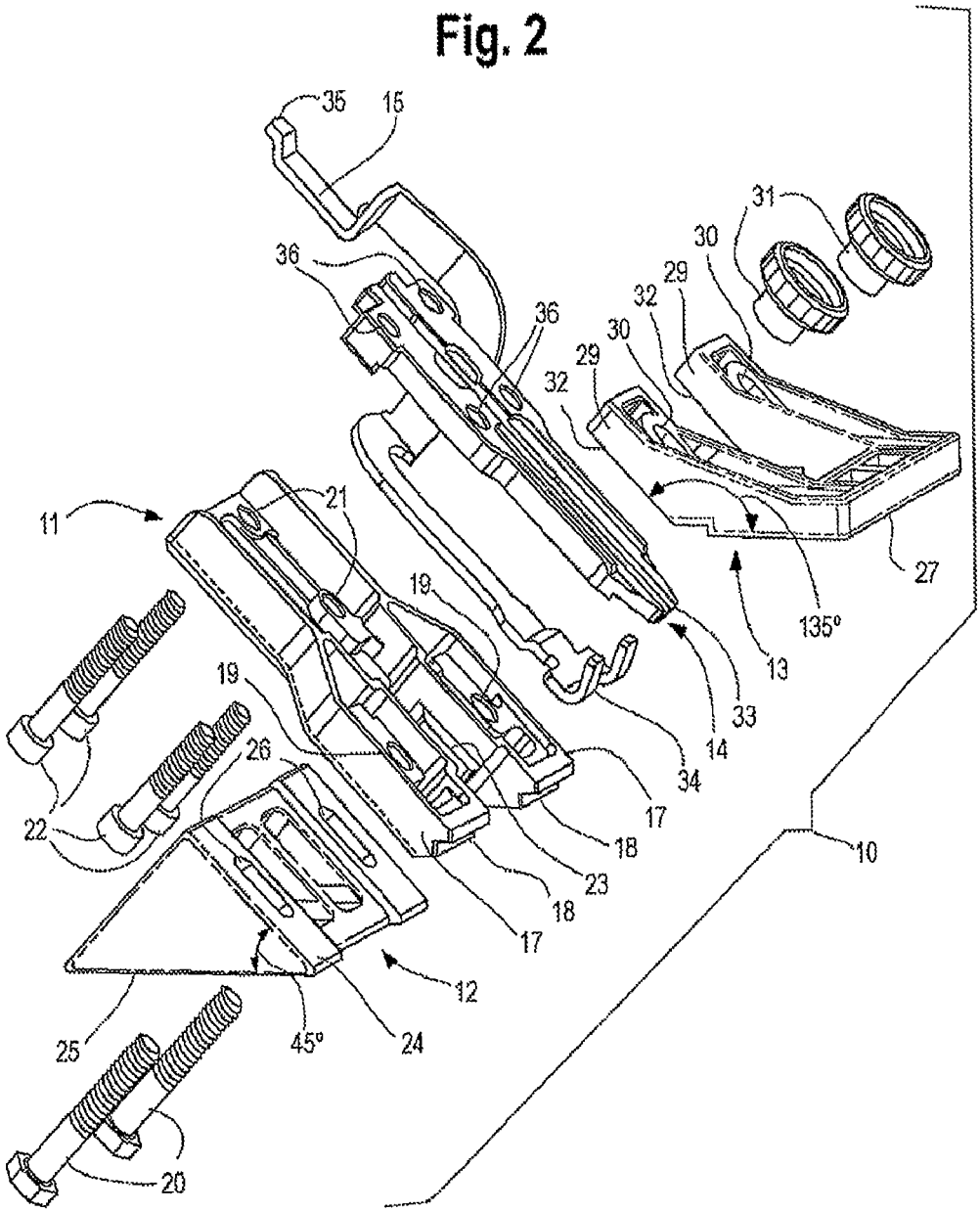
FIG. 2. is an exploded perspective view of the adjustable adapter of the present invention.
Figure 3:
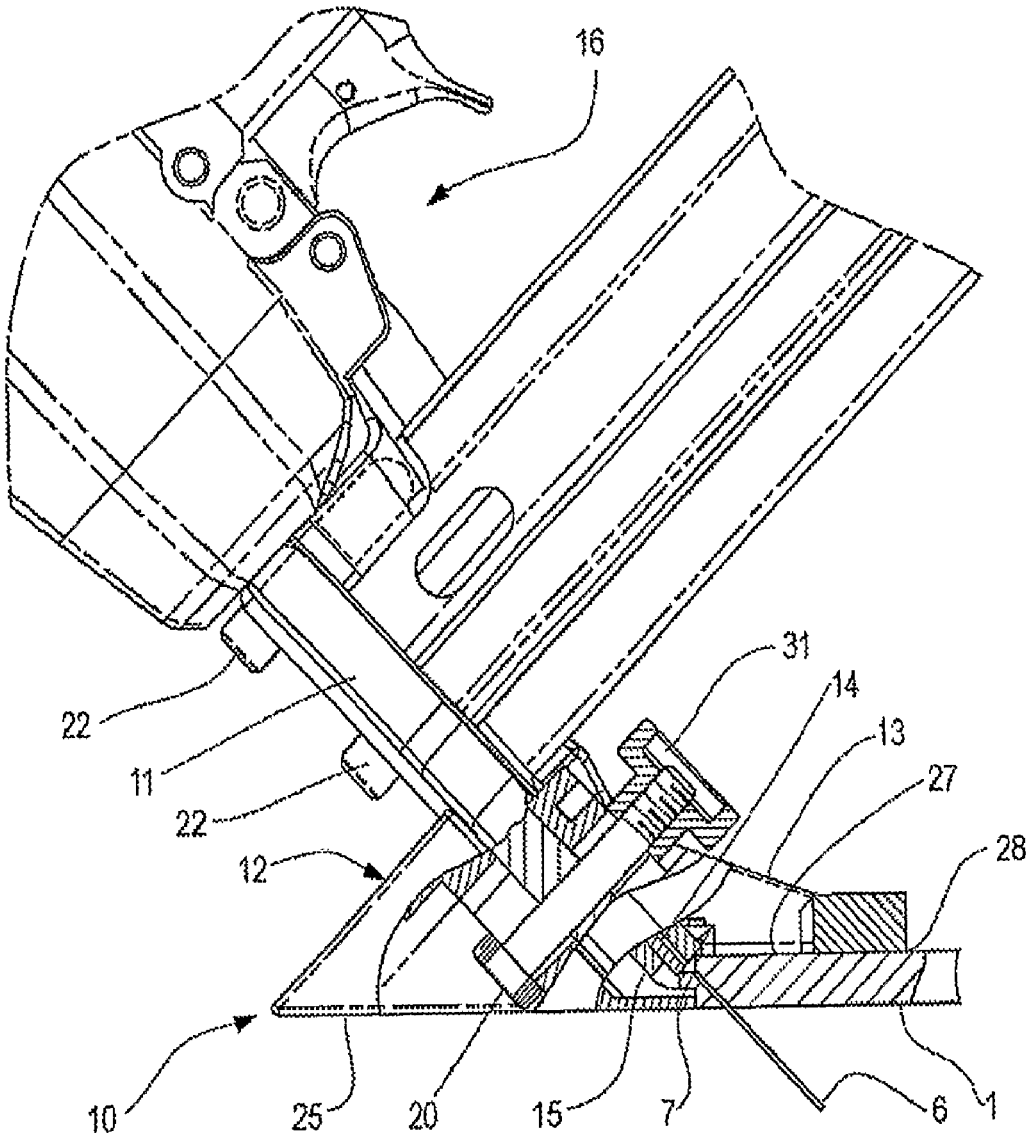
FIG. 3 is a partial cross-sectional view of the adjustable adapter of the present invention with a fastening tool mounted thereto shown after driving a nail into a tongue-and-groove flooring strip; and, FIG. 4 is a side view of the adjustable adapter of FIG. 3.
Figure 4:
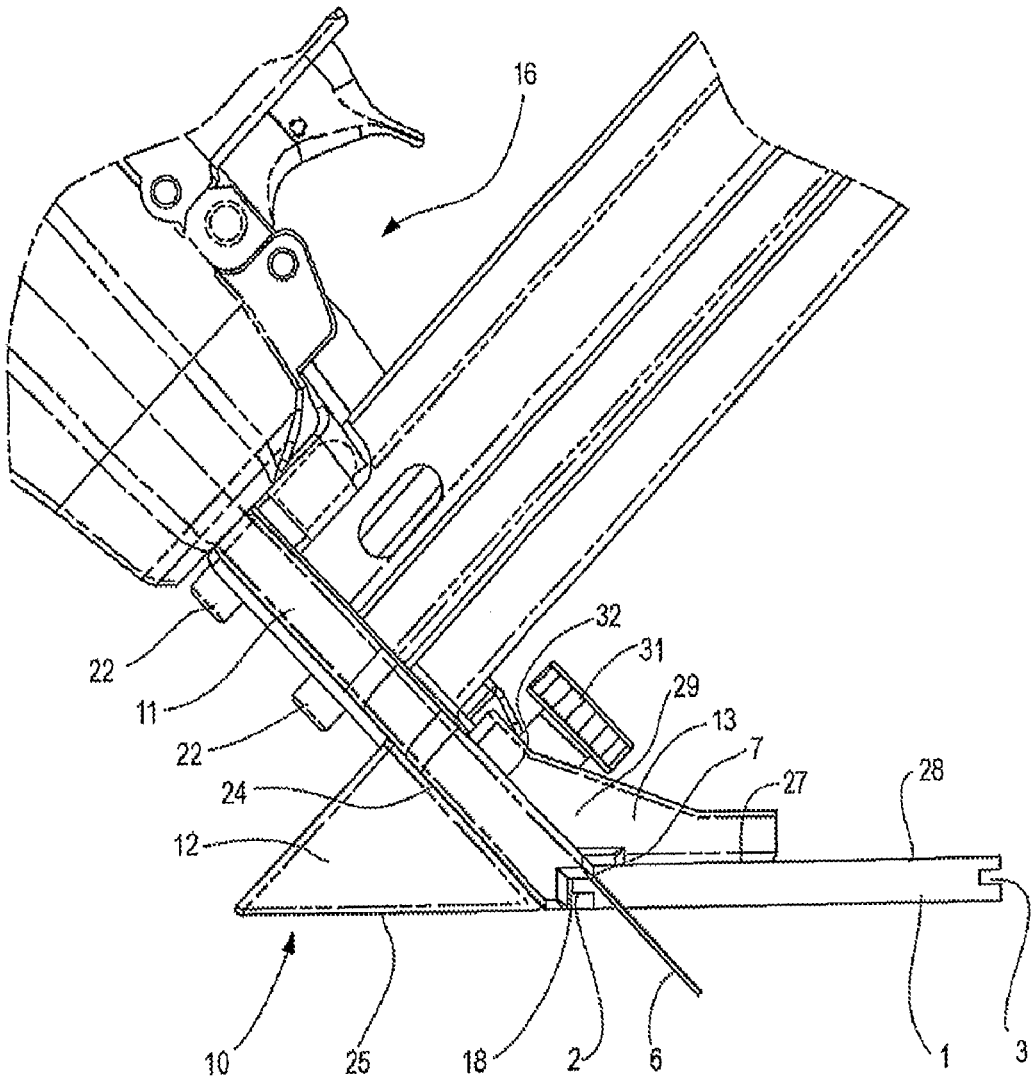

The adjustable adapter 10 of the present invention is shown in FIGS. 2-4. In the preferred embodiment, adapter 10 comprises a fastening tool mounting plate 11, a base 12 slidably mounted to the bottom of mounting plate 10 and a support plate 13 slidably mounted to the top of mounting plate 10.

Mounting plate 11 is a generally Y-shaped body formed with a pair of arms 17 extending forwardly therefrom. Arms 17 are formed with shoulders 18 at their distal ends configured to matingly engage tongue 2 of strip 1. Arms 17 further include a plurality of adjustment bores 19 configured to permit passage adjustment screws 20, as discussed below.

Mounting plate 11 is further formed with an inner cavity 23 configured to receive a nose plate 14 of fastening tool 16. Nose plate 14 of a fastening tool 16 is disposed between mounting plate 11 and support plate 13. Nose plate 14 serves a guide through which fastener 6 is directed into strip 1 and subfloor 4 when fastening tool 16 is activated. Cavity 23 is further configured to receive a safety actuator arm 15, as further discussed below, disposed between mounting plate 11 and nose plate 14.

Mounting plate 11 also includes a plurality of attachment bores 21 configured to permit passage of attachment screws 22 for attachment of mounting plate 11 to fastening tool 16.

In the preferred embodiment, base 12 is a generally wedge-shaped body and is configured with a mounting surface 24 disposed at an angle of 45 degrees relative to the bottom surface 25 of base 12. Base 12 is configured to slidably engage mounting plate 11 along mounting surface 24.

Base 12 further comprises two elongated bores 26, extending through the body of base 12 from mounting surface 24 to bottom surface 25. Elongated bores 26 are configured to permit passage of adjustment screws 20 from bottom surface 25, upwardly through elongated bores 26, and through adjustment bores 19 in arms 17 of mounting plate 11. Such a configuration permits base 12 to slidably move with respect to mounting plate 11 by a distance equal to length of elongated bores 26.

Support plate 13 in the preferred embodiment is a generally U-shaped body comprising a flat flooring material engagement surface 27 configured to engage the top surface 28 of strip 1. Support plate 13 further comprises a pair of arms 29 extending rearwardly and upwardly from support plate 13 and disposed at an angle of 135 degrees relative to engagement surface 27. Arms 29 are configured to slidably engage mounting plate 11 along mounting surfaces 32 of arms 29.

Support plate 13 further comprises two elongated bores 30, extending through arms 29 of support plate 13. Elongated bores 30 are configured to permit passage of adjustment screws 20 upwardly through elongated bores 30 of arms 29 such that adjustment screws 20 may threadedly engage adjustment knobs 31. Such a configuration permits support plate 13 to slidably move with respect to mounting plate 11 by a distance equal to length of elongated bores 30.

Many fastening tools 16 include a firing safety mechanism (not shown) which ensures that nose plate 14 is adjacent to strip 1 before fastening tool 16 can be activated. The mechanism includes safety actuator arm 15 which extends along nose plate 14 and is disposed within cavity 23 of mounting plate 11 beneath nose plate 14. Arm 15 is slidably movable within cavity 23. A first end 34 of arm 15 is configured to extend beyond the end 33 of nose plate 14, and a second end 35 of arm 15 is configured to engage the firing mechanism of fastening tool 16. When end 34 comes in contact with strip 1, arm 15 slides rearwardly within cavity 23 such that second end of arm 15 engages the firing mechanism of fastening tool 16, allowing fastening tool 16 to be fired.

Adapter 10 is assembled by positioning mounting plate 11 on mounting surface 24 of base 12 such that adjustment bores 19 are aligned over elongated bores 26 of base 12. Safety actuator arm 15 is positioned within cavity 23 of mounting plate 11 and nose plate 14 is positioned above arm 15 within cavity 23. Support plate 13 is then aligned over mounting plate 11 such that elongated bores 30 of arms 29 are aligned over adjustment bores 10 of mounting plate 11.

Adjustment screws 20 then are passed from bottom surface 25 of base 12, upwardly through elongated bores 26 of base 12, through adjustment bores 19 in arms 17 of mounting plate 11 and through elongated bores 30 in arms 29 of support plate 13. Adjustment knobs 31 are threadedly engaged with adjustment screws 20 and tightened such that base 12, mounting plate 11 and support plate 13 form adapter 10, along with nose plate 14 and safety actuator arm 15.

Adapter 10 is secured to fastener tool 16 by passing attachment screws 22 upwardly through attachment bores 21 of mounting plate 11 and attachment bores 36 of nose plate 14. Attachment screws are then threadedly engaged with bores (not shown) in the body of fastener tool 16.

In use, adapter 10 may be used to secure strip 1 to subfloor 4 as follows. First, strip 1 is positioned on subfloor 4 in the desired location. Next, adjustment knobs 31 are loosened to permit slidable movement of base 12 and support plate 13 relative to mounting plate 11. Then, shoulders 18 of arms 17 of mounting plate 11 are positioned in mating engagement with tongue 2 of strip 1.

While maintaining the position of mounting plate 11, base 12 is slidably adjusted such that bottom surface 25 of base 12 is disposed flat against subfloor 4. Then, support plate 13 is slidably adjusted such that engagement surface 27 of support plate 13 is disposed flat against top surface 28 of strip 1. Adjustment knobs 31 are then tightened to preserve the position of base 12 and support plate 13 relative to mounting plate 11. Fastening tool 16 is then activated in order to drive fastener 6 into corner 7 above tongue 2 of strip 1.

When base 12 and support plate 13 are set as described above, and when shoulders 18 of arms 17 of mounting plate 11 are positioned in mating engagement with tongue 2 of strip 1, as described above, fastener 6 will be driven into strip 1 and subfloor 4 at a 45 degree angle and will enter strip 1 at corner 7 above tongue 2.

Once the positions of base 12 and support plate 13 have been set relative to mounting plate 11 for a particular size and configuration of strip 1, adapter 10 may be used repeatedly to drive multiple fasteners 6 into multiple strips 1 to complete a tongue-and-groove flooring installation.

Should it be desired to use tongue-and-groove flooring having a different thickness, tongue dimension and/or distance between the tongue and the bottom of the strip, adapter 10 may be readily adjusted, as described above, to accommodate such changes while maintaining the desire fastener driving angle and location.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

What is claimed is:

1. An adjustable adapter for positioning a fastening tool to drive a fastener into a tongue-and-groove flooring material to secure the flooring material to a subfloor, the adapter comprising:

a fastening tool mounting plate having a top and a bottom;

a generally wedge-shaped base slidably mounted to the bottom of the mounting plate; and, a support plate slidably mounted to the top of the mounting plate;

wherein the mounting plate is configured to engage a tongue extending outwardly from an edge of the tongue-and-groove flooring material and to direct the fastener into an interface between the tongue and the edge of the tongue-and-groove flooring material;

wherein the base is configured to maintain the mounting plate at an angle relative to the subfloor; and wherein the support plate is configured to engage a top surface of the tongue-and-groove flooring material, and wherein the base and the support plate are movable relative to the mounting plate, and wherein movement of the base relative to the mounting plate causes the mounting plate to engage the tongue, and wherein movement of the support plate relative to the mounting plate causes the support plate to engage the top surface of the tongue-and-groove flooring material.

2. The adjustable adapter of claim 1 wherein the interface comprises a corner formed by the tongue and the edge of the tongue-and-groove flooring material.

3. The adjustable adapter of claim 1 further comprising a fastener tool nose plate, the nose plate disposed between the mounting plate and the support plate.

4. The adjustable adapter of claim 3 further comprising a safety actuator arm, the safety actuator arm disposed between the mounting plate and the nose plate.

5. The adjustable adapter of claim 4 wherein the mounting plate comprises an inner cavity, wherein the nose plate and the safety actuator arm are disposed within the cavity.

6. The adjustable adapter of claim 1 further comprising a plurality of attachment screws extending through the mounting plate and into a body of the fastening tool.

7. The adjustable adapter of claim 1 wherein the base, the mounting plate and the support plate each comprise a plurality of bores formed therein, the plurality of bores configured to permit passage of a plurality of adjustment screws therethrough.

8. The adjustable adapter of claim 7 further comprising a plurality of adjustment knobs threadably engaged with the plurality of adjustment screws, the plurality of adjustment knobs configured cooperate with the plurality of adjustment screws to fasten the base, the mounting plate and the support plate.

9. The adjustable adapter of claim 7 wherein the plurality of bores formed in the base are elongated and extend through the base from the bottom surface to a mounting surface.

10. The adjustable adapter of claim 1 wherein the mounting plate comprises a pair of arms extending forwardly therefore, the arms having shoulders configured to matingly engage the tongue of the tongue-and-groove flooring material.

11. The adjustable adapter of claim 1 wherein the base comprises a bottom surface and a mounting surface, the mounting surface disposed at an angle of about 45 degrees relative to the bottom surface.

12. The adjustable adapter of claim 1 wherein the support plate comprises a flat flooring material engagement surface configured to engage the top surface of the tongue-and-groove flooring material.

13. The adjustable adapter of claim 12 wherein the support plate further comprises a pair of arms extending rearwardly and upwardly from the support plate and disposed at an angle of about 135 degrees relative to engagement surface.

14. The adjustable adapter of claim 13 wherein each arm comprises an elongated bore extending therethrough.

* * * * *